US007223218B2

(12) United States Patent
Karafa

(10) Patent No.: US 7,223,218 B2
(45) Date of Patent: May 29, 2007

(54) MUSCLE STRENGTHENING DEVICE

(76) Inventor: Michael A. Karafa, 820 Cedar Ave., Pittsburgh, PA (US) 15212-4812

( * ) Notice: Subject to any disclaimer, the term of this patent is extended or adjusted under 35 U.S.C. 154(b) by 199 days.

(21) Appl. No.: 10/857,080

(22) Filed: May 28, 2004

(65) Prior Publication Data

US 2005/0266969 A1 Dec. 1, 2005

(51) Int. Cl.
*A63B 21/02* (2006.01)

(52) U.S. Cl. ..... 482/126; 482/121

(58) Field of Classification Search ..... 473/219, 473/223, 239, 243; 482/121, 126, 110, 115, 482/122

See application file for complete search history.

(56) References Cited

U.S. PATENT DOCUMENTS

| | | | | | |
|---|---|---|---|---|---|
| 1,324,404 | A | * | 12/1919 | Metzger | 482/127 |
| 2,921,791 | A | * | 1/1960 | Berne | 482/118 |
| 3,784,193 | A | * | 1/1974 | Simjian | 482/147 |
| 3,957,266 | A | * | 5/1976 | Rice | 482/91 |
| 4,570,925 | A | | 2/1986 | Kock et al. | |
| 5,040,788 | A | | 8/1991 | Randall | |
| 5,158,299 | A | | 10/1992 | Otter | |
| 5,199,713 | A | | 4/1993 | Kinoshita | |
| 5,755,646 | A | * | 5/1998 | Chu | 482/118 |
| 5,947,835 | A | | 9/1999 | Fenton, Jr. | |
| 6,013,013 | A | | 1/2000 | Wolf | |
| 6,174,270 | B1 | | 1/2001 | Dagenais | |
| 6,210,303 | B1 | | 4/2001 | Miller et al. | |
| 6,277,030 | B1 | | 8/2001 | Baynton et al. | |
| 6,537,184 | B2 | | 3/2003 | Kim | |

OTHER PUBLICATIONS

Ad for Cybex.

* cited by examiner

*Primary Examiner*—Stephen R. Crow
*Assistant Examiner*—Allana Lewin
(74) *Attorney, Agent, or Firm*—Alicia M. Passerin, Esq.; Cohen & Grigsby, P.C.

(57) ABSTRACT

An apparatus for strengthening hand, wrist, forearm, and shoulder muscles, thereby increasing performance and reducing the risk of injury in sports that utilize a swinging motion, such as golf, tennis, or baseball. The apparatus is also used to rehabilitate injured muscles and connective tissue in the wrist, forearm, and shoulder.

The apparatus consists of two cam assemblies connected to a extensible support that has an adjustable height. The cam assemblies are adjustable relative to the coronal plane of the player's body and each comprises a support, a rotatable cam, a handle, and a resistive band. Each handle is adjustable relative to the sagittal plane of the player's body. The ability to adjust the apparatus in three planes means that a player is able to focus on the development of sport-specific muscles by adjusting the apparatus to mimic the swing used for a particular sport.

5 Claims, 4 Drawing Sheets

MUSCLE STRENGTHENING DEVICE

FIELD OF THE INVENTION

The invention relates to an exercise apparatus for strengthening muscles. Specifically, the invention relates to an exercise apparatus that strengthens the user's forearm and wrist muscles, thereby improving the user's swing in sports that utilize a swinging motion, such as golf, tennis or baseball.

BACKGROUND OF THE INVENTION

Many athletes who participate in sports such as golf, tennis, or baseball wish to increase the power of their swing. The prior art has recognized the importance of muscle strengthening to achieve this goal, and there are a number of exercising devices known in the prior art that are devoted to strengthening the muscles used in a swinging motion. None of these devices, however, have become widely used.

U.S. Pat. No. 6,013,013 to Wolf shows an "apparatus . . . directed towards improving the strength and endurance of the muscles of the axial skeleton and lower extremities while instilling proper swing dynamics." Col. 3, lines 26–29. "[T]he user stands on support base 10 with the extensible support attachment 8 across his/her shoulders, with his/her hands gripping the extensible support attachment, and with the axial extensible support 6 thus supported by his/her shoulders and arms. While positioned in this manner, the user simulates the body movements of a golf stroke. The attachment assembly 8 facilitates rotation about the first rotational axis 2 and the second rotational axis 4 of the hips and shoulders, respectively, of the exerciser/golfer." Col. 3, lines 33–41.

U.S. Pat. No. 6,537,184 B2 to Kim teaches a swing exerciser that has a handle 10, a slotted track 20, and a resistance cord 15 extending between the handle 10 and a pulley 35 that moves along the track 20 as the swing proceeds. "Pulley 35 starts at the top of track 20 . . . at the beginning of a swing exercise and moves to the bottom of track 20 as the swing approaches the hitting region . . . . This movement of pulley 35 down track 20 is resisted so that the exerciser has to apply force to handle 10 to overcome the resistance and thereby exercise and strengthen the muscles used in executing the swing." Col. 2, lines 52–59.

U.S. Pat. No. 4,570,925 to Kock and Schuster discloses two mechanisms, one for handgripping and one for forearm twisting and wrist casting. The mechanism for handgripping "utilizes an extension spring connected via cable to a pivoting arm with a gripping handle. Squeezing this movable handle against a parallel fixed handle causes the cable to stretch the extension spring which thereby provides the resistance force." Col. 3, lines 26–30. The tension on the cable and the gripping stroke length are adjustable. The mechanism for forearm twisting and wrist casting uses a "friction disk to provide torsional resistance. The fixed handle of the gripping mechanism serves as the handle for the twisting and casting motions. The entire handle system rotates about the axis of the gripping mechanism cable . . . . This arrangement permits the simultaneous operation of the gripping mechanism and the rotatable friction disk mechanism during certain exercises," Col. 3, lines 42–50, and "simulates a casting motion . . . [that is used] in tennis strokes, golf swings and the like." Col. 6, lines 1–3.

The present invention is an improvement over the prior art because it permits adjustment in three planes, and therefore adjusts to each user's particular height, arm length, and torso length, as well as each user's individual stance for a given sport. The ability to adjust the apparatus in three planes means that a user is able to focus on the development of sport-specific muscles by adjusting the apparatus to mimic the swing used for a particular sport. Specifically, the invention mimics the swinging motion involved in sports such as golf, tennis, or baseball by rotating the hands, wrists, forearms, and shoulders, thereby strengthening the muscles used in the swinging motion and increasing the power of the user's swing.

SUMMARY OF THE INVENTION

The invention is a novel exercise apparatus that strengthens and enhances neuromuscular coordination and performance by mimicking the specific positions used in various sports, particularly, but not limited to, those sports that require the use of clubs, racquets, or bats. Specifically, the apparatus focuses on strengthening the forearm and wrist muscles. The apparatus adjusts to the user's height and is also adjustable in or relative to the coronal and sagittal planes of the user's body so as to permit use in a wide variety of stance positions.

The present exercise apparatus comprises an extensible support, a first cam assembly, and a second cam assembly. The extensible support has first and second ends. The height of the extensible support is adjustable to accommodate the user's height. The first and second cam assemblies are adjustably connected to the first end of the extensible support such that the orientation of the assemblies is adjustable within the sagittal plane of the user's body so as to accommodate a position of the user's arms in a specific sports stance. The first and second cam assemblies each comprise a support, a cam, a handle, and a resistive band. Each support is connected to the first end of the extensible support. The supports are adjacent to each other. Each cam is rotatably connected to the corresponding support and rotates in a first direction. Each handle is adjustably connected to the corresponding cam so that the handle can be adjusted relative to the sagittal or coronal planes of the body. The adjustable handle permits the exercise equipment to be used for muscle training for a variety of sports by enabling the user to approximate the orientation of the hands used to grip a particular piece of sports equipment, such as a club, bat, or racquet. Each resistive band is connected to the corresponding cam and is tensioned in the first direction. In an embodiment, the resistive bands are of equal resistance. In another embodiment, the resistive bands are interchangeable with additional pairs of resistive bands of either greater or lesser resistance.

In an embodiment, the first and second cam assembly each further comprise a pair of anchors and a pair of locking mechanisms. A first member of each anchor pair is attached to the cam and a second member of the anchor pair is attached to the second end of the support. A first locking mechanism is attached to the first end of the resistive band and the second locking mechanism is attached to the second end of the resistive band. The first locking mechanism lockably engages the first anchor member and the second locking mechanism lockably engages the second anchor member. In a preferred embodiment, the first and second locking mechanisms are a first and second plastic spools, each spool having a hole in a center through which an end of the resistive band is inserted. The first spool lockably engages the first anchor member by sliding into an opening in the first anchor member. The second spool lockably engages the second anchor member by sliding into an opening in the second anchor member. The resistive bands are of a length such that when the first and the second locking mechanisms lockably engage the first and the second anchor members, respectively, the resistive band is taut.

In an embodiment, the second end of the extensible support is attached to a base, the base having a plurality of levelers on a bottom surface. A top surface of the base is made of a non-slip material.

In other embodiments, the height of the extensible support is adjusted by a skewer having a quick-release lever on an end.

In another embodiment, the first and the second cam assemblies are adjustable as a single unit. A connector is attached to the first end of the extensible support and is positioned in between the first and the second supports. A bolt extends through the first support, the connector, and the second support. A cam lock on an end of the bolt allows the position of the cam assemblies to be adjusted as a single unit within the sagittal plane.

Still in other embodiments, a first handle mount is attached to a face of the first cam, the first handle being adjustably connected to the first handle mount. A second handle mount is attached to a face of the second cam, the second handle being adjustably connected to the second handle mount. The position of the handles in the handle mounts is adjustable relative to the sagittal or coronal plane of the user's body in order to permit the exercise equipment to be used for muscle training for a variety of sports by enabling the user to approximate the orientation of the hands used to grip a particular piece of sports equipment, such as a club, bat, or racquet.

And in another embodiment, a first stopping mechanism is attached to the first cam assembly and a second stopping mechanism is attached to the second cam assembly. Each stopping mechanism has two components, one attached to the first end of the support and one attached to a back side of the cam. When the two components of each stopping mechanism come into contact with each other, the cam cannot rotate in a second direction.

OBJECTS OF THE INVENTION

It is an object of the invention to provide a piece of exercise equipment that mimics the motions of various sports, especially those that use clubs, racquets, or bats, thereby strengthening and enhancing neuromuscular coordination and performance.

It is another object of the invention to provide a piece of exercise equipment that adjusts to the player's specific sports-impact position.

It is still a further object of the invention to provide a piece of exercise equipment that adjusts to the player's specific height.

It is still a further object of the invention to provide a piece of exercise equipment that increases resistance to injury of muscles, ligaments, and connective tissues used in the swinging motion by strengthening those muscles.

It is still a further object of the invention to provide a piece of exercise equipment that rehabilitates injured muscles, ligaments, and connective tissues that are used in the swinging motion.

DETAILED DESCRIPTION OF THE PREFERRED EMBODIMENT

The present invention is an exercise apparatus that strengthens and enhances neuromuscular coordination and performance by mimicking the specific positions used in various sports, particularly those sports that require the use of clubs, racquets, or bats.

Figure 1:
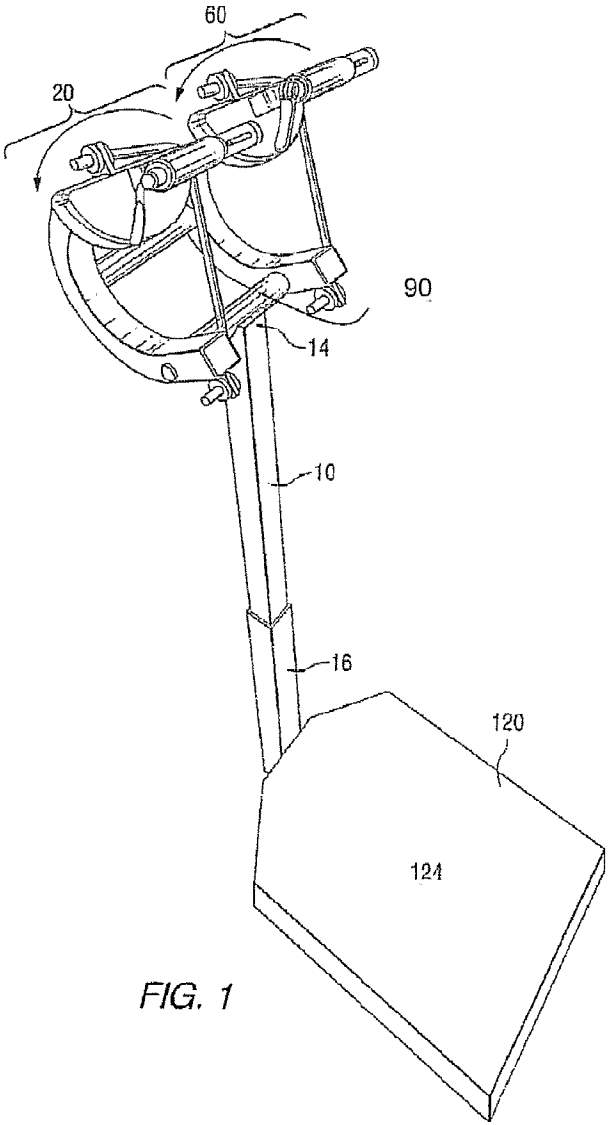
FIG. 1 is an isometric view of the invention.
Figure 2:
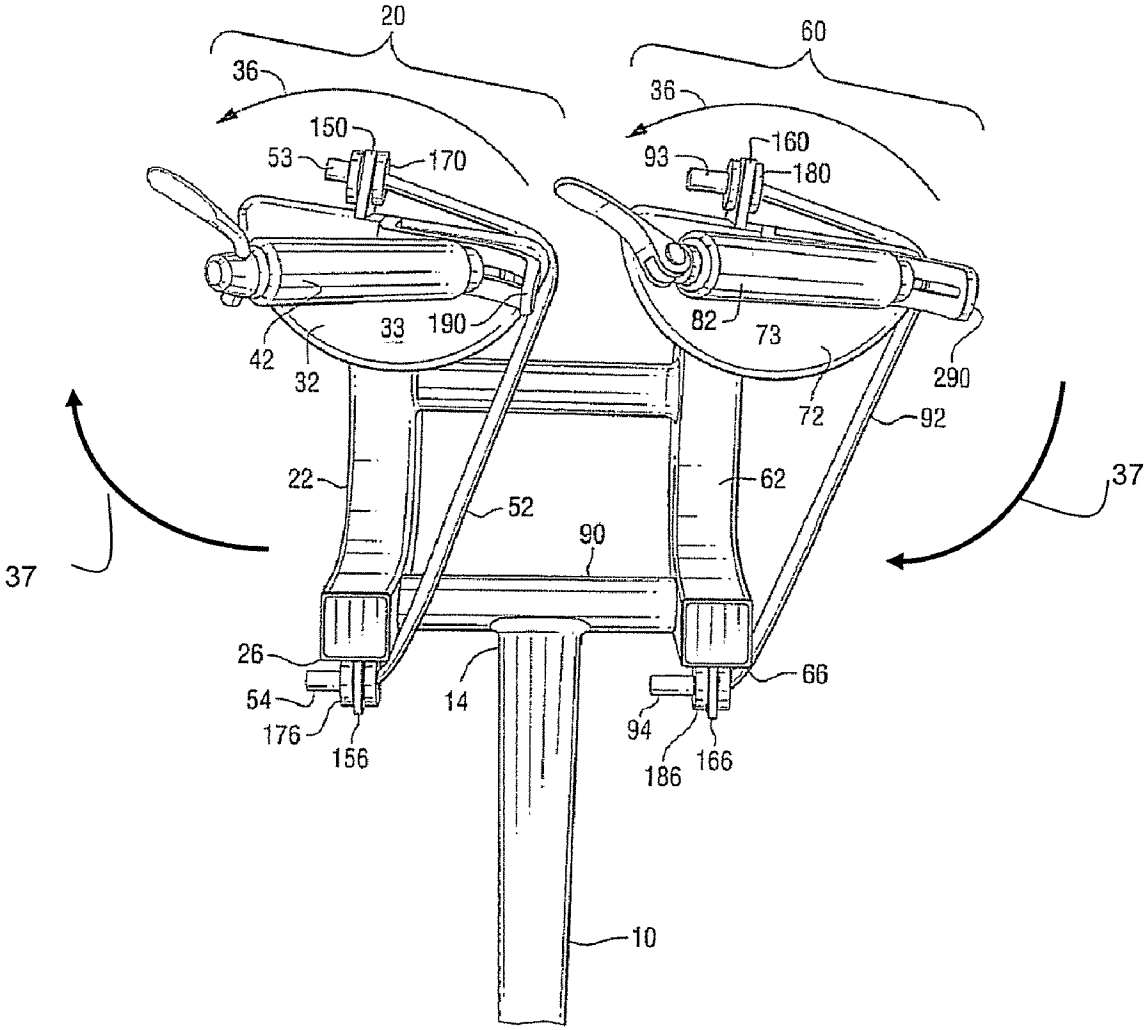
FIG. 2 is a back view of the cam assembly units attached to a extensible support.
Figure 3:
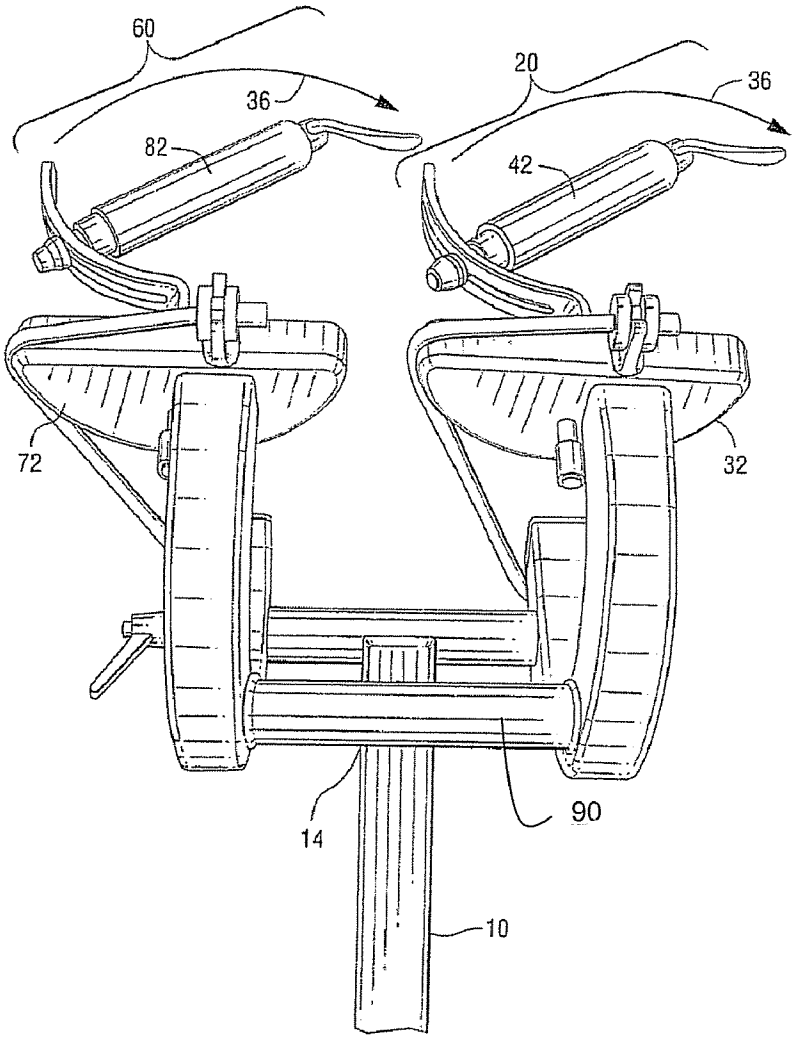
FIG. 3 is a front view of the cam assembly units attached to a extensible support.
Figure 4:
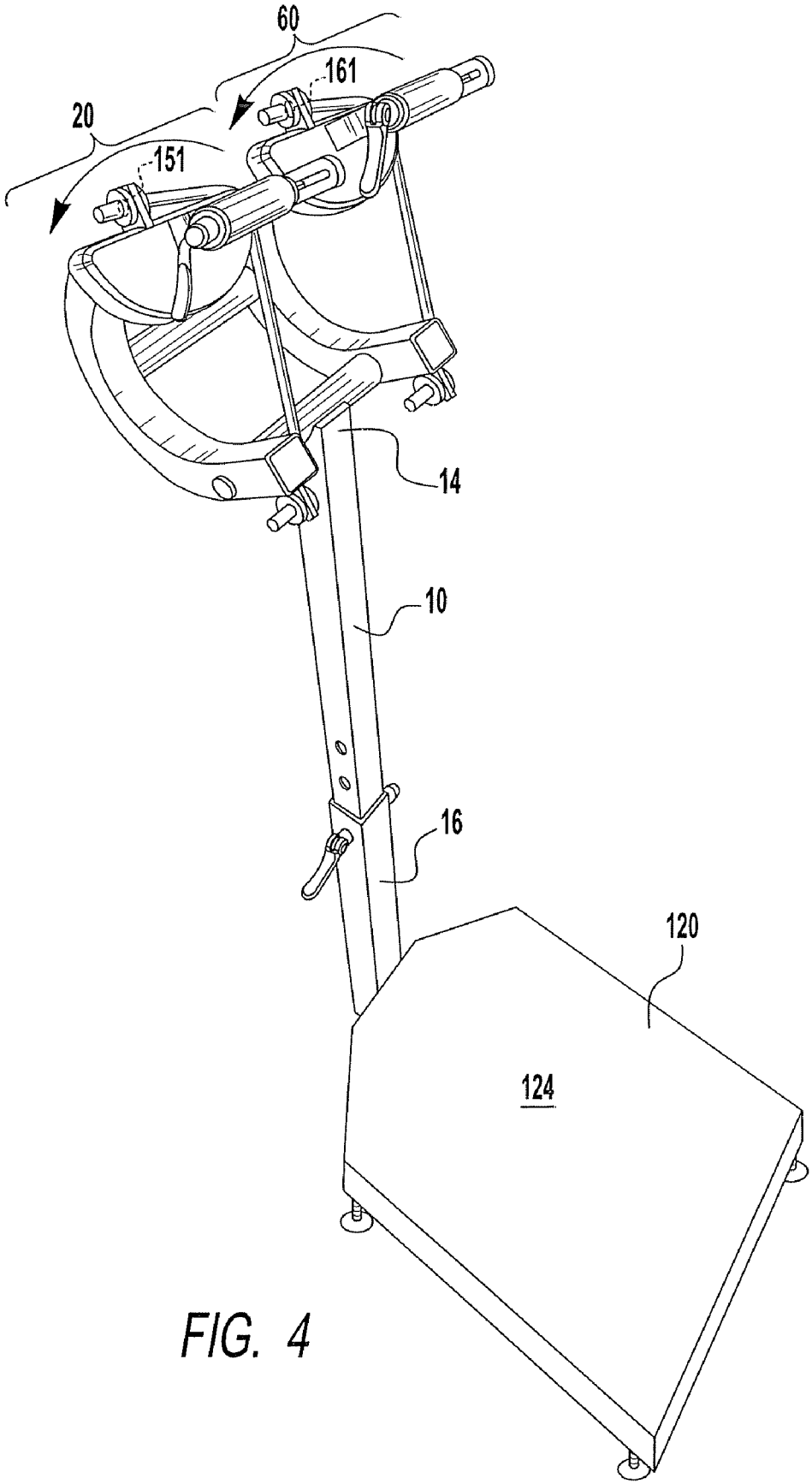
FIG. 4 is an isometric view of the invention.

FIGS. 1 through 4 show the preferred embodiment of the exercise apparatus according to the present invention. The invention comprises an extensible support 10 having a first end 14 and a second end 16, a first cam assembly 20, and a second cam assembly 60. Cam assemblies 20 and 60 are adjacent. In the preferred embodiment, second end 16 of support 10 is attached to a base 120. Optionally, a plurality of levelers 121 are attached to a bottom surface of base 120. A top surface 124 of base 120 is made of a non-slip surface. In the preferred embodiment, support 10 is made of two lengths of telescoping tubing and the height is adjusted by a skewer having a quick-release lever 17.

The first cam assembly 20 and second cam assembly 60 are adjustably connected to first end 14 of support 10 and are adjustable within the sagittal plane of the player's body.

It will be appreciated by those skilled in the art that basic planes of movement with respect to the body are the sagittal plane and the coronal plane. A sagittal plane is vertical and extends from front to back, deriving its name from the direction of the sagittal suture of the skull. It may also be called an anterior-posterior plane. The median sagittal plane, mid-sagittal, divides the body into right and left halves. A coronal plane is vertical and extends from side to side, deriving its name from the direction of the coronal suture of the skull. It is also called the frontal or lateral plane, and it divides the body into an anterior and posterior portion.

Cam assemblies 20 and 60 are adjustable within the sagittal plane of the user's body. First cam assembly 20 comprises a cam support 22, a cam 32, a handle 42, and a resistive band 52. An end of cam support 22 is connected to a connector or cross bar 90 that is in turn connected to first end 14 of extensible support 10. Cam 32 is rotatably connected to cam support 22 and rotates in direction 36. Handle 42 is adjustably connected to cam 32 and can be adjusted relative to the coronal or sagittal planes of the user's body. Resistive band 52 is connected to cam 32. In a preferred embodiment, anchor 150 is attached to cam 32 and anchor 156 is attached to the end 26 of cam support 22.

A locking mechanism 170 is attached to a first end 53 of resistive band 52 and a second locking mechanism 176 is attached to a second end 54 of resistive band 52. Locking mechanism 170 lockably engages anchor member 150 and locking mechanism 176 lockably engages anchor member 156. Resistive band 52 is of a length and a resistance such that when locking mechanisms 170 and 176 lockably engage anchor members 150 and 156, respectively, resistive band 52 is taut.

Second cam assembly 60 comprises a cam support 62, a cam 72, a handle 82, and a resistive band 92. An end of support 62 is connected to a connector or cross bar 90 that is in turn connected to the first end 14 of extensible support 10. Second cam assembly 60 is adjustable within the sagittal plane of the player's body. Cam 72 is rotatably connected to support 62 and rotates in a direction 36. Handle 82 is adjustably connected to cam 72 and can be adjusted relative to the sagittal or coronal planes of the user's body. Resistive band 92 is connected to cam 72 and is tensioned in direction 36. In a preferred embodiment, anchor 160 is attached to cam 72 and anchor 166 is attached to the end 66 of cam support 62. A locking mechanism 180 is attached to a first end 93 of resistive band 92 and a second locking mechanism 186 is attached to a second end 94 of resistive band 92. Locking mechanism 180 lockably engages anchor member 160 and locking mechanism 186 lockably engages anchor member 166. Resistive band 92 is of a length and a resistance such that when locking mechanisms 180 and 186 lockably engage anchor members 160 and 166, respectively, resistive band 92 is taut.

In the preferred embodiment, locking mechanism 170, 180 and 176, 186 is a plastic spool having a center hole through which first or second end, respectively, of resistive band is inserted. A locking mechanism 170, 176, 180, 186 lockably engages anchor member 150, 156, 160, 166 by sliding into an opening in anchor member 150.

In the preferred embodiment, the first cam assembly 20 and second cam assembly 60 are adjustable in the sagittal plane (relative to the user's body) as a single unit as shown generally in the figures. A connector 90 is attached to the first end of extensible support and is positioned between cam supports. A bolt extends through cam support, connector, and cam support. A cam lock on an end of bolt allows first cam assembly and second cam assembly to be adjusted as a single unit relative to the sagittal plan of the user's body.

Handle mounts 190, 290 are attached to faces 33, 73 of cams 32, 72. The position of handles is adjustable relative to the sagittal or coronal planes of the user's body to permit the exercise equipment to be used for muscle training for a variety of sports by enabling the user to approximate the orientation of the hands used to grip a particular piece of sports equipment, such as a club, racquet, or bat.

In an embodiment, the invention comprises a stopping mechanism to prevent cam 32 from rotating in a second direction. Stopping mechanism (not shown) is made up of two components, one attached to a back side of cam, and one attached to a proximal end of support. An identical stopping mechanism is used to prevent cam from rotating in a second direction.

In an embodiment, a variety of pairs of bands 52 and 92 are available, each pair having a different resistance and each band in a pair of resistive bands being of equal resistance. Resistive bands 52 and 92 are preassembled to have a locking mechanism on each end.

Prior to use, a user selects a pair of resistive bands 52 and 92. The user attaches resistive band 52 to the apparatus by inserting locking mechanism 170 into opening 151 of anchor 150 and locking mechanism 176 into opening of anchor 156. The player then attaches resistive band 92 to the apparatus by inserting locking mechanism 180 into opening 161 in anchor 160 and locking mechanism 186 into opening in anchor 166. The player stands on base 120 squarely facing the apparatus with knees flexed. The player adjusts the height of extensible support 10, the position of cam assemblies 20 and 60 within the sagittal plane of the user's body, and the position of handles 42 and 82 relative to the sagittal or coronal planes of the user's body to approximate the orientation of the hands used to grip a particular piece of sports equipment, such as a club, racquet, or bat.

In use, the player grips handles 42 and 82 as he or she would grip the club, racquet, or bat. For a right-handed player, handle 42 is gripped so that the palm of the left hand is on a top side 44 of handle 42, and handle 82 is gripped so that the palm of the right hand is on a bottom side 83 of handle 82 (not shown). While gripping handles 42 and 82, the player rotates cams 32 and 72 in direction 36 (i.e., for a right-handed player, the cams are rotated in a counter-clockwise direction) using a controlled motion against the resistance. Cams 32 and 72 then rotate back in direction 37 until the cams are in the original starting position. This process is performed for desired number of repetitions.

Resistance of resistive bands 52, 92 can be varied and the speed of rotation can be varied. For example, using a lighter resistance in combination with a higher speed of rotation will increase the speed of the swing, while using a higher resistance in combination with a smaller number of repetitions will increase muscle strength. Finally, using a lighter resistance in combination with more repetitions will increase circulation to muscles and soft tissues, which will facilitate recovery from injury.

While presently preferred embodiments of the invention have been shown and described, the invention may be otherwise embodied within the scope of the appended claims.

What is claimed is:

1. An exercise apparatus that strengthens or rehabilitates a user's muscles, said apparatus comprising:

a. an extensible support having first and second ends;

b. first and second adjacent cam assemblies that are connected to said first end of said support and are adjustable within a sagittal plane of a body of said user, each said cam assembly comprising:

i. a rotatable cam that rotates in a first direction;

ii. a resistive band connected to said rotatable cam, said resistive band being tensioned in said first direction;

iii. a handle that is connected to said rotatable cam and is adjustable relative to a coronal and/or sagittal plane of said user's body; and iv. a cam support connected to said first end of said extensible support and to which said rotatable cam is mounted.

2. An exercise apparatus as in claim 1 wherein said resistive band is a length of resilient tubing.

3. An exercise apparatus as in claim 1 wherein a resistance of said resistive band of said first cam assembly is substantially equal to a resistance of said resistive band of said second cam assembly.

4. An exercise apparatus as in claim 1 wherein said first and second cam assemblies each further comprise a handle mount attached to a face of said cam, said handle being adjustably connected to said handle mount by a skewer having a quick-release lever on an end.

5. An exercise apparatus as in claim 1 wherein said first and second cam assemblies each further comprise first and second locking mechanisms attached to first and second ends, respectively, of said resistive band, said first locking mechanism lockably engaging a first anchor member mounted on said cam and said second locking mechanism lockably engaging a second anchor member mounted to said cam support.

* * * * *